US009044989B2

(12) United States Patent
Roof et al.

(10) Patent No.: US 9,044,989 B2
(45) Date of Patent: Jun. 2, 2015

(54) SYSTEMS AND METHODS FOR FORMING AND IMPLEMENTING BOOK BINDING GEOMETRIES AS A FUNCTION OF STACK THICKNESS

(71) Applicant: XEROX Corporation, Norwalk, CT (US)

(72) Inventors: Bryan J. Roof, Newark, NY (US); Santokh S. Badesha, Pittsford, NY (US); Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 127 days.

(21) Appl. No.: 13/897,569

(22) Filed: May 20, 2013

(65) Prior Publication Data

US 2014/0341677 A1 Nov. 20, 2014

(51) Int. Cl.
*B42B 5/10* (2006.01)
*B42B 5/08* (2006.01)

(52) U.S. Cl.
CPC . *B42B 5/08* (2013.01); *B42B 5/103* (2013.01); *B42B 5/10* (2013.01)

(58) Field of Classification Search
CPC ..... B42B 5/103; B42B 5/10
USPC ..... 412/7, 8, 40, 41
See application file for complete search history.

(56) References Cited

U.S. PATENT DOCUMENTS

| | | | | | |
|---|---|---|---|---|---|
| 2,273,824 | A | * | 2/1942 | Barrett | 412/40 |
| 2,571,525 | A | * | 10/1951 | Blitstein | 412/7 |
| 2,686,932 | A | * | 8/1954 | Zaleski | 425/384 |
| 2,930,054 | A | * | 3/1960 | Bardy | 412/7 |
| 3,107,375 | A | * | 10/1963 | Byland et al. | 412/41 |
| 3,280,240 | A | * | 10/1966 | Bardy | 264/242 |
| 3,433,688 | A | * | 3/1969 | Winkelmann et al. | 412/40 |
| 4,208,750 | A | * | 6/1980 | Pfaffle | 412/7 |

* cited by examiner

*Primary Examiner* — Kyle Grabowski
(74) *Attorney, Agent, or Firm* — Ronald E. Prass, Jr.; Prass LLP

(57) ABSTRACT

A system and method are provided for forming and implementing book binding geometries as a function of image receiving medium stack thicknesses for automated book binding in image forming devices. The disclosed schemes optimize book binding employing a plurality of strip-like binding elements to form loops in a process that employs heat and pressure to reduce residual stresses in the strips as they are formed into loops. The disclosed schemes mechanically modify a process of bending individual book-binding elements in a manner that more effectively employs less expensive material elements to provide consistent and durable "right-sized" book binding of finished documents. A combination of heat and pressure are introduced with a molded structure that results in controlling a radius of formation to be consistently followed by the "folded" binding elements in order to relieve the stress and preserve the integrity of those binding elements in the finished product.

26 Claims, 5 Drawing Sheets

SYSTEMS AND METHODS FOR FORMING AND IMPLEMENTING BOOK BINDING GEOMETRIES AS A FUNCTION OF STACK THICKNESS

BACKGROUND

1. Field of Disclosed Subject Matter

This disclosure relates to systems and methods for forming and implementing book binding geometries as a function of image receiving medium stack thicknesses for automated book binding in image forming devices.

2. Related Art

Myriad methodologies are implemented for document finishing. Certain of these finishing document finishing methodologies implement book binding techniques for providing book-type bound documents as completed and finished products. In in-line bookbinding equipment that may be associated with certain sophisticated image forming devices as post-processing and/or finishing devices, a number of different techniques and materials may be employed.

Wire binding is among the most popular commercial document book binding methods albeit that it can be difficult to implement is smaller scale applications. With this book binding method, punched pages may be inserted onto a shaped wire spine. A wire closer is then employed to squeeze the shaped wire spine until the shaped wire spine is rounded providing both a functional apparatus for securing the finished and bound book-type image product, and an aesthetically pleasing look to the finished and bound book-type image product. Conventionally, documents that are bound with wire binding will open completely flat on a desk and allow for unimpeded rotation of bound pages through 360 degrees to allow the opened pages to be folded back on the book in a familiar manner.

Another common commercial binding method employs a pre-fabricated plastic "comb" spine appliance binding that may be provided in one or more discrete "standard" diameters according to a proposed finished book-type document overall thickness. This method is less flexible, but somewhat easier to implement on a smaller scale of overall image forming and finishing operations. The overall thickness to be secured by any such appliance is based on a number of pages and a thickness of each image receiving medium substrate comprising the individual pages, as well as any separately provided front or back cover page elements, which may be of differing thicknesses. Comb binding appliances represent a most common way today to bind the pages together into a book-type finished document today as they are functional, aesthetically pleasing and generally easy to handle in finishing the book-type document. Standardly, comb binding appliances may use round plastic spines with 19 rings for standard letter size document pages and 21 rings for standard A4 size document pages. A cooperative page punching apparatus is typically employed to align the pages and to drill the stacks of pages with sets of rectangular holes. To bind a multi-page document, an appliance is employed to first punch the holes in the set of pages comprising the finished book-type document. Pages may be punched as a full set or may be punched a few pages at a time. In instances where rigid, or otherwise semi-rigid, cover components may be provided, the cover components may be punched as well.

Typically, based on a limited number of discrete standard diameter size binder comb appliances, a user is forced to choose a spine size that may not precisely match a thickness of the finished book-type document. Standard sizes available for the plastic comb binding appliances may include, for example, a 3/16 inch diameter for binding 10 sheets of 20# paper in discrete sizes up to typically 2 inches in diameter for binding more than 400 sheets 20# paper, with appropriate section dividers and front and back cover elements. A difficulty arises in that rarely will a size of the plastic comb binding appliance closely match a thickness of the finished book-type document that it binds.

In plastic comb binding, rings on the plastic comb spine open in order that the pages comprising the finished book-type document may be mounted thereon. With plastic comb binding, as with wire binding, the plastic comb is configured in a manner that allows the finished bound book to lie substantially flat, but potentially not opened to a full 360 degrees. For a book that can be opened such that the covers touch, a spine that does not have an obstructive body, such as a wire coil binding may be considered a preferable option, albeit that it may be more difficult to implement.

SUMMARY OF THE DISCLOSED EMBODIMENTS

Another common finishing concept for book binding of documents, typically employed by the Assignee of this subject matter, employs a mechanical in-line binding finishing device. The function of the mechanical in-line binding finishing device is to produce bound sets of documents by punching each sheet within the set, compiling or stacking the punched sheets, and then inserting into the punched holes a plurality of individual binding elements (often comprised of plastic), which may be sequentially cut from a strip of binding material. Each of the individual binding elements is subsequently formed into a loop and sealed with an adhesive to form as a set of binding elements a mechanical bind of the compiled set of finished and punched sheets as the book-type document.

More specifically, after a set of finished and punched sheets has been completed with the one or more binding elements in place, the one or more of the binding elements are formed as loops around each of the plurality of rectangular punch locations. The radius of the loops formed of the individual binding elements varies with a thickness of the set of finished and punched sheets. As the thickness of the documents to be bound decreases, the individual binding elements are bent in a manner that may produce both localized regions of yielding and residual stresses from the forming operation that may lead to defects such as fractures of the individual binding elements.

In the forming operation, as the individual binding elements are bent, a certain strain is introduced. Additionally, a stress remains in the finished product once the end tabs of the binding elements bent back on themselves are adhered to one another to form the closed looped binding element. As a radius of the loop is decreased, these physical effects of strain and stress increase. Because there is no forming method other than folding in typical use for these limitedly-compliant elements, e.g., no radius of a bend is carefully maintained, binding smaller numbers of pages results in fairly aggressive bending that often leads to breakage regardless of the compliant nature of the material of which the individual binding elements are formed.

Additionally, the binding element materials are exposed to ultraviolet (UV) light over their lifetime. This UV light exposure tends to embrittle the binding elements. It has been observed that when the loops of the individual binding elements are compressed, e.g., by pinching them together, the individual binding elements have been known to break both in manufacture and in use. Breakage during manufacture causes significant waste in the manufacturing process. Breakage later renders the integrity of the bound set of finished and punched sheets to be totally unacceptable to the customer. So, once provided in use, and exposed to ultraviolet radiation over significant periods of time, deterioration occurs causing individual binding elements that were not fractured initially to later break. When a plurality of individual ones of the elements finding a particular finished book-type document break, the aesthetically pleasing nature of the book-type document is lost, and the functionality of the bound book type document may be adversely affected as well.

Furthermore, in the case where multiple sets of bound pages are being produced, a set of binding elements that is substantially taller than the stack of pages being bound will result in stacking issues such as a skewed stack of bound books.

Physical constraint considerations must be accounted for in a material selection process for the individual binding elements. In selecting materials for these elements, there is a balance struck generally between providing materials that are supple enough to be formed in any binding configuration without breaking and yet that are inexpensive enough to remain economically feasible.

The above-listed difficulties can lead to significant customer dissatisfaction in a finished and bound product. In an effort to avoid this dissatisfaction, more compliant, and coincidentally more expensive, materials have been employed to address the particularly identified shortfalls in typical embodiments. The increased expense is, however, a significant disadvantage.

It would be advantageous in view of the above-noted shortfalls in conventional employment of individual book-binding elements to determine some manner by which to more effectively employ less expensive material elements to provide consistent and durable "right-sized" book binding of finished documents.

Exemplary embodiments of the systems and methods according to this disclosure may provide a mechanism by which, in the formation of a looped and adhered (plastic) book binding element, certain stress relief is introduced into the book-binding element formation process.

Exemplary embodiments may introduce a combination of heat and pressure in a molded structure that results in controlling a radius of formation to be consistently followed by the "folded" binding elements in order to relieve the stress and preserve the integrity of those binding elements in the finished product.

Exemplary embodiments may provide the variable radii for the finished looped binding elements in order to accommodate, on the fly, varying thicknesses of the finished book-type documents in a conformal manner.

Exemplary embodiments may include book-type binding elements that do not substantially increase a thickness, even along the binding, of a finished book-type document.

Exemplary embodiments may balance considerations of maximizing a bend radius for the individual book-type binding elements to preserve a structural integrity of the binding elements, while minimizing any increase in thickness to the finished products introduced by the radii of the individual book-type binding elements.

Exemplary embodiments may provide a scheme in the form of an algorithm or series of steps to implement variable binding element employment based on a stack thickness for the finished book-type bound document. This scheme and/or algorithm accounts for the variability necessary to accomplish the balancing of the above-indicated objectives regarding maximizing and minimizing radii of the bends in the binding elements.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and systems and methods for forming and implementing book binding geometries as a function of image receiving medium stack thicknesses for automated book binding in image forming devices will be described, in detail, with reference to the following drawings, in which.

DETAILED DESCRIPTION OF THE DISCLOSED EMBODIMENTS

The systems and methods systems and methods for forming and implementing book binding geometries as a function of image receiving medium stack thicknesses for automated book binding in image forming devices according to this disclosure will generally refer to this specific utility or function for those systems and methods. Exemplary embodiments described and depicted in this disclosure should not be interpreted as being specifically limited to any particular configuration of the described elements, or as being specifically directed to any particular intended use. Any advantageous combination of schemes that may employ a particular unit for applying heat or pressure to book binding elements with an objective of relaxing stress and strain introduced in a bending process for particular binding elements are contemplated as being encompassed by this disclosure.

Specific reference to, for example, various configurations of image forming devices, post-processors, book-binding schemes, and book-binding elements, as those terms are used throughout this disclosure, should not be considered as limiting those terms to any particular configuration of the respective devices, system configurations or elements. The use of each of the terms is intended to broadly encompass systems, devices, schemes and elements that may involve image forming and finishing operations as those operations would be familiar to those of skill in the art.

FIGS. 1-4 illustrate a series of schematic representations of a process for forming book binding that may be improved according to the systems and method of this disclosure.

Figure 1:
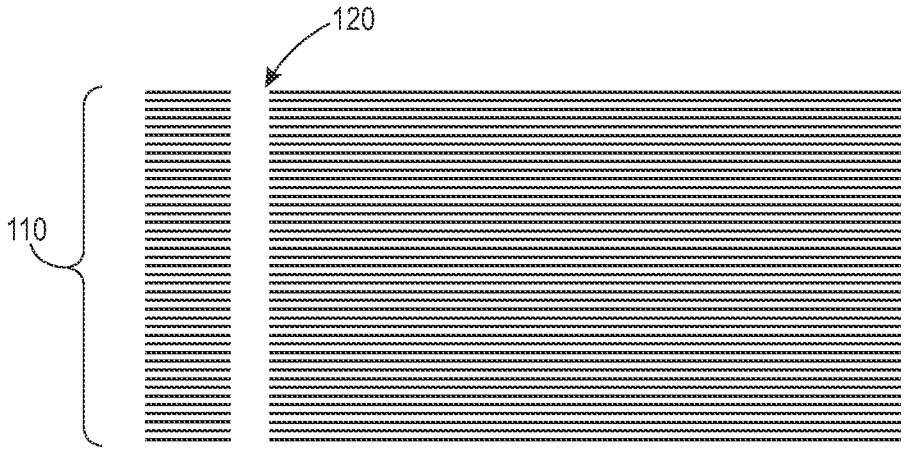
FIGS. 1-4 illustrate a series of schematic representations of a process for forming book binding that may be improved according to the disclosed systems and methods.

As shown in FIG. 1, a stack of collected and collated sheets 110 may be assembled at an output of an image forming device. The collected and collated stack of sheets 110 may then be drilled, in whole or in part, in order to provide a plurality rectangular holes 120 (only one of which is shown in the profile view provided in FIG. 1) ultimately penetrating all of the sheets that are in the collected and collated stack of sheets 110.

Figure 2:
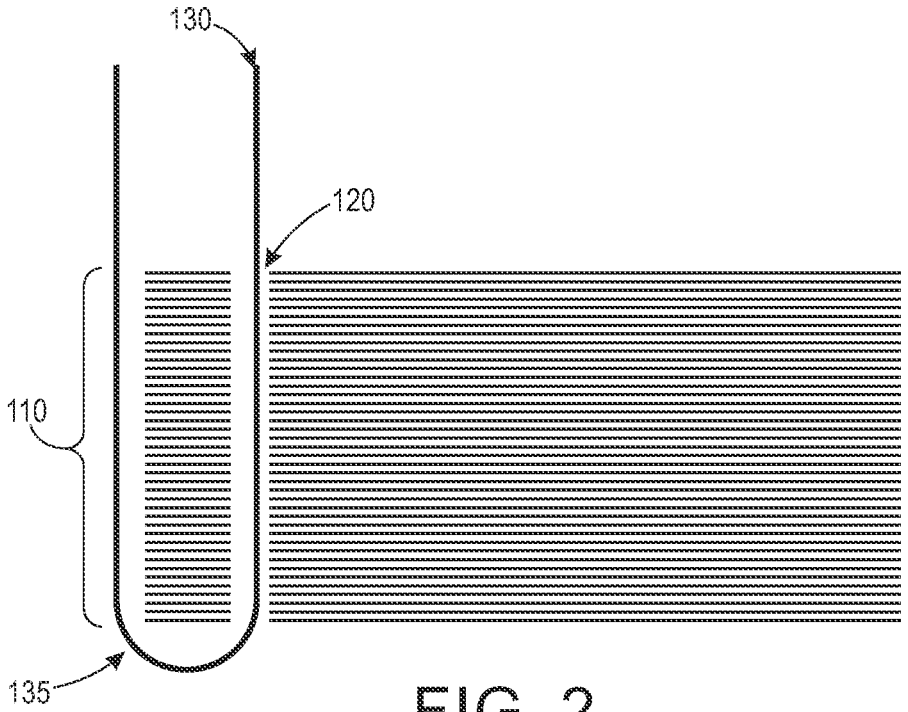

As shown in FIG. 2, a plurality of individual binding elements 130 (again only one of which is shown in the profile view provided in FIG. 2) may be introduced one each in to each of the plurality of rectangular holes 120 drilled through the collected and collated stack of sheets 110. Often provided as a single strip of binding material, the individual binding elements 130 may be formed by cutting the single strip of binding material and then producing, in each of the individual binding elements 130, a bend portion 135.

Figure 3:
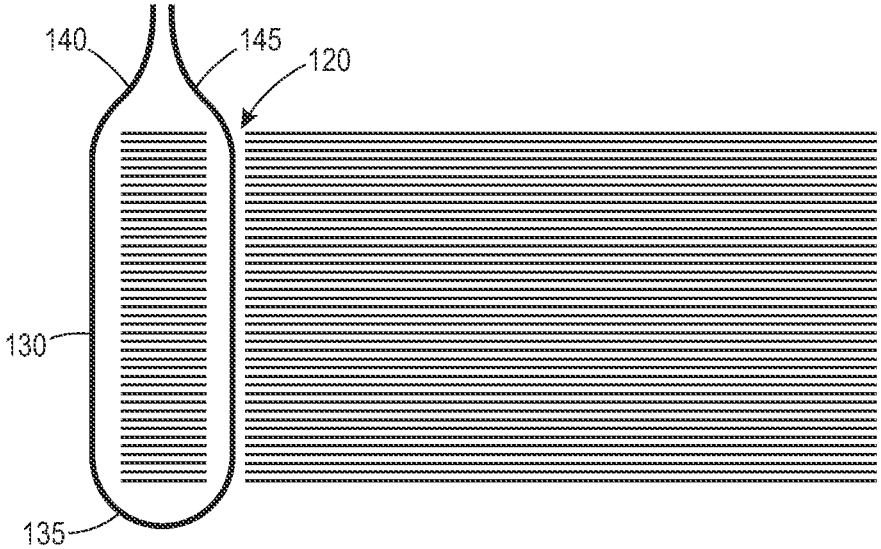

FIG. 3 shows free ends 140,145 of the individual binding elements 130 being forced together in order that the free ends 140,145 may be brought into close contact with one another.

Figure 4:
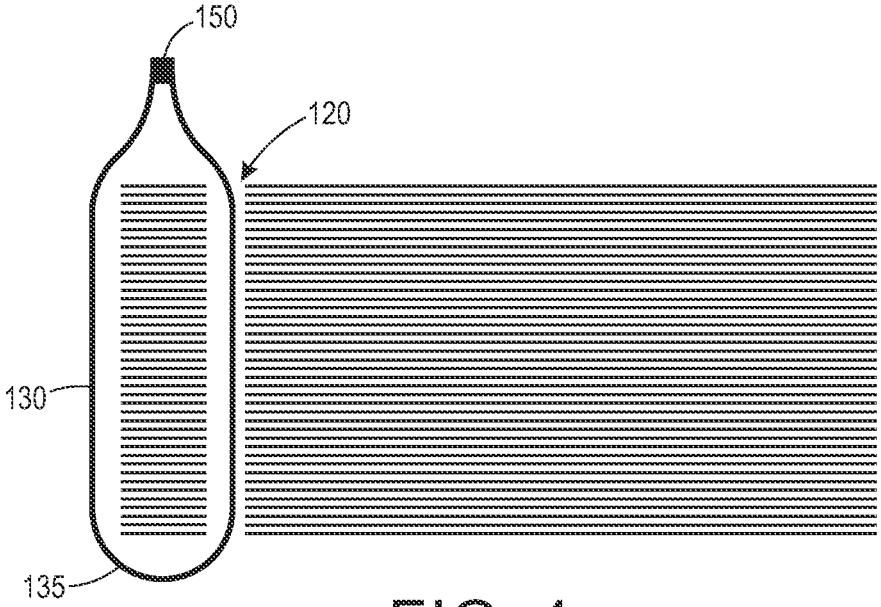

FIG. 4 then represents a completion of the binding element formation process in which an adhesive 150 is introduced to affix the free ends of the individual binding elements 130 to one another to form a completed plurality of binding elements 130 to bind the collected and collated stack of sheets 110.

As indicated above, the process of bending the plurality of binding elements 130 at the bend portion 135 and at the free ends 140,145, as shown in FIGS. 2-4, introduces certain stresses and strains to the individual binding elements 130. Leaving a comparatively maximum radius in the bend portion 135 tends to significantly reduce the stress, but introduces other difficulties. A desire to relieve the stress by maximizing a bend radius in the binding elements, therefore, must be balanced against a desire for a minimum bend radius to the binding elements that tends to lead to overall conformance of the individually-bent binding elements to a stack-height thickness of the finished document products.

In embodiments, a heatable bending unit may be provided in which a depth to which the individual binding elements 130 are received by the heatable bending unit may be usable to produce varying bend radii in the bend portions 135 of the individual binding elements 130. Certain variability in the production of the individual radii of the bend portions 135 for the individual binding elements 130 provides a flexibility that is not currently enjoyed and a conformability with varying thicknesses of finished book-type documents. An ability to provide variable radii is appropriate to balance the desired physical parameters for the binding elements 130 comprising the finished binder-type document. Based on a required stack height, there may be, however, a minimum radius beyond which the individual binding elements 130 may not be bent as such minimal bend radii, even under the disclosed stress relieving schemes may lead unavoidably to fracture of the individual binding elements 130.

The variability in formed radii for the bend portions 135 of the individual binding elements 130 is an objective of the systems and methods according to this disclosure. The variability provides an effective scheme by which to balance competing "requirements" of objectives of a maximum radius promoting structural integrity and objectives of a minimum radius for promoting close conformance with a stack height for the collection of pages comprising the finished document.

An advantage of the disclosed concept over a simple materials selection process which may find an optimal, albeit expensive, material solution is that comparatively simple mechanics can be employed to modify the strength of, and reduce the residual stress in, a finished product across a broad spectrum of materials applications. In other words, one may select a less expensive material, or employ a thinner profile for a particular material, leading to less expense in the overall product as well. Thinner, less expensive stock will lead to ever-increasing cost reductions as larger volumes of produced bound documents accrue.

Figure 5:
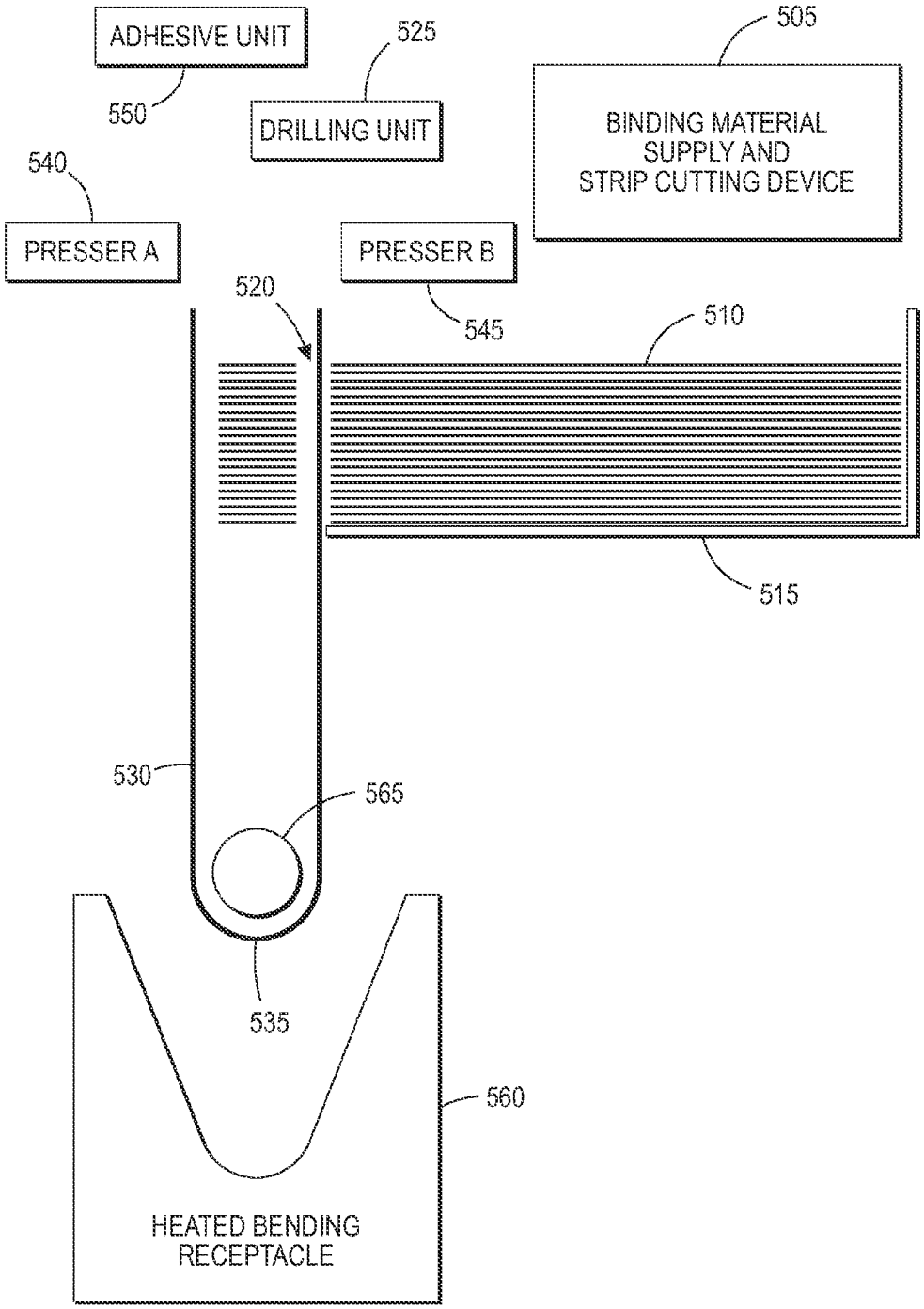
FIG. 5 illustrates an exemplary embodiment of an apparatus for facilitating bookbinding according to the disclosed systems and methods.

FIG. 5 illustrates an exemplary embodiment of an apparatus for facilitating book binding according to the disclosed systems and methods. As shown in FIG. 5, a stack of collected and collated sheets 510 may be collected and collated in a tray 515 and then drilled with a drilling unit 525 to produce a plurality of rectangular holes 520 through the collected and collated stack of sheets 510. A plurality of individual binding element strips 530 may be provided and cut from a binding material supply and strip cutting device 505 and threaded individually through the plurality of rectangular holes 520.

Unique to the disclosed binding schemes, a heated through rod 565 may be provided in proximity to, or in contact with, an "internal" surface of the plurality of individual binding elements 530 at a position corresponding to what is intended to be formed as bend portions 535 in the individual binding elements 530. Separately and further uniquely, a heatable bending unit 560 may be provided to receive the individual binding elements 530 and heated through rod 565 to facilitate the bending process of the plurality of individual binding elements 530 at the bending portions 535.

Once the bending of the individual binding elements 530 is completed, pressers A,B 540, 545 may be brought into contact with the free ends of the individual binding elements 530 to press them together to be attached to one another by means of an appropriate adhesive dispensed from an adhesive unit 550.

A proposed radius for the bending portion 535 may be calculated based on a calculation or a measurement of an overall thickness of the collected and collated stack of sheets 510. Using the calculated radius, a depth may be determined that the heated through rod 565 may be advanced into an opening in the heatable bending unit 560. It may be desirable, based on the paper stack thickness, to determine a desired maximum radius for the bend portion 535.

Simply stated, knowing the basis weight of the individual sheets and the number of sheets in the job, an average stack thickness may be relatively easily determined according to known methods. For example, for a typical 20# paper, a thickness per sheet is known to be roughly 100 microns. An overall stack thickness can be calculated by multiplying an average sheet thickness by the number of sheets in the print job. Otherwise, an overall stack thickness may be directly measured using, for example, a stack thickness measurement device in the tray 515. By calculating a radius for the bending portion 535 to be according to some minimum threshold, a stress concentration factor may be reduced while maintaining minimal overall height for the finished product including the sheet stack and the finished binding elements.

A temperature of the heatable bending unit 560 and the heated through rod 565 may be set, for example, to impart a temperature to the individual binding elements 530 at the bend portions 535. This temperature may be controlled to be above a glass transition temperature, but below a melting temperature, for the material of which the individual binding elements 530 may be formed. In embodiments, the temperature of the heated through rod 565 and of the heatable bending unit 560 may be controlled to be different temperatures to optimize the bending operation imparted to the individual binding elements 530. Either of the heated through rod 565 or the heatable bending unit 560 may be brought into contact with the individual binding elements 530 first, i.e., in either order or at the same time as may be appropriate to change a temperature profile throughout a cross section the individual binding elements 530 by changing a time of each of the heated elements in contact with the opposing surfaces of the individual binding elements.

The heated though rod 565 may be retractable in the context of the disclosed device to be movable out of the way for binding element insertion. A retractable mechanism (not shown) may be appropriate to facilitate binding element insertion to a correct depth in the heatable bending unit 560 without introducing any permanent deformation to regions of the individual binding elements 530 that are not intended to be bent, curved or otherwise deformed based on incidental and unwanted contact with other portions of the heatable bending unit 560.

The control of the bending process may be undertaken based on a material and a material thickness for the individual binding elements 530. The control system indicated below may store information on particular sets of materials and materials properties, and may be a part of the system or device operator settings. Essentially, for a given material and a given thickness of that material, standard thermoforming calculations may be internally performed to determine appropriate conditions of heat, and potentially pressure as well, that are appropriate to heat the binding element materials to a non-destructive softening point in order that the binding elements may be bent into a final desired shape.

An objective is to reduce the residual stress that is introduced as the individual binding elements 530 are inserted in the channel drilled through the stack of sheets and then bent back to the adhesive backing point. Annealing of a material of which the individual binding elements 530 are formed, including a plastic, may relieve the stresses, but an annealing process is generally considered to be too time consuming. It is for this reason that the disclosed scheme proposes simply guiding the bend portions 535 under heated conditions such that the individual binding elements 530 are heated close to a glass transition temperature for the involved material. The bending process then represents a bending and flow problem instead of strictly a bending problem. The principles of thermoforming that may be employed in the disclosed schemes are well understood in the plastics industry. These principles are uniquely employed in the novel approach to book binding discussed in this disclosure.

By reducing residual stress according to the disclosed scheme according to a process that maximizes a bend radius in balance with other considerations in the disclosed binding process, structural integrity margin is gained over conventionally formed binding elements that experienced the breakage problems. UV exposure and embrittlement, to the extent that they are still concerns, may be addressed in a material selection process apart from concern over the bend resilience of the material selected. The selected material could be optimized to address embrittlement concerns, aesthetics and cost, setting aside the concerns regarding optimal bend radii.

Equation 1 below describes a potential relationship between elastic modulus and yield strength of the material for the binding elements as well as the radius of curvature or length of the element to predict a required thickness in an attempt to maintain the binding element within an elastic limit of the binding element material. Considering a relationship of the radius of curvature to applied stress, Equation 1 is used to calculate the thickness of the binding element to prevent breaking the material from bending during the book binding process.

$$\text{Thickness}=2*(\sigma/E)*\rho \qquad \text{Equation 1}$$

where $\rho$=radius of curvature, E=elastic modulus and $\sigma$=bending yield strength of the material.

In experiments, three samples were secured with varying modulus. The relationship specified according to Equation 1 indicates that for a given radius of curvature, i.e., a number of bound pages, and a given ratio of yield strength to modulus, a preferable thickness according to the specified relationship may ensure that the binding elements bend elastically. Thicknesses were derived in a range of 0.150 mm to 0.385 mm for the experimental conditions testing the three samples.

This discussion is not intended to limit individual binding elements 530 to any particular configuration, design, radius or material. It should be recognized that there are many alternatives to each of the disclosed considerations that may be applicable.

Figure 6:
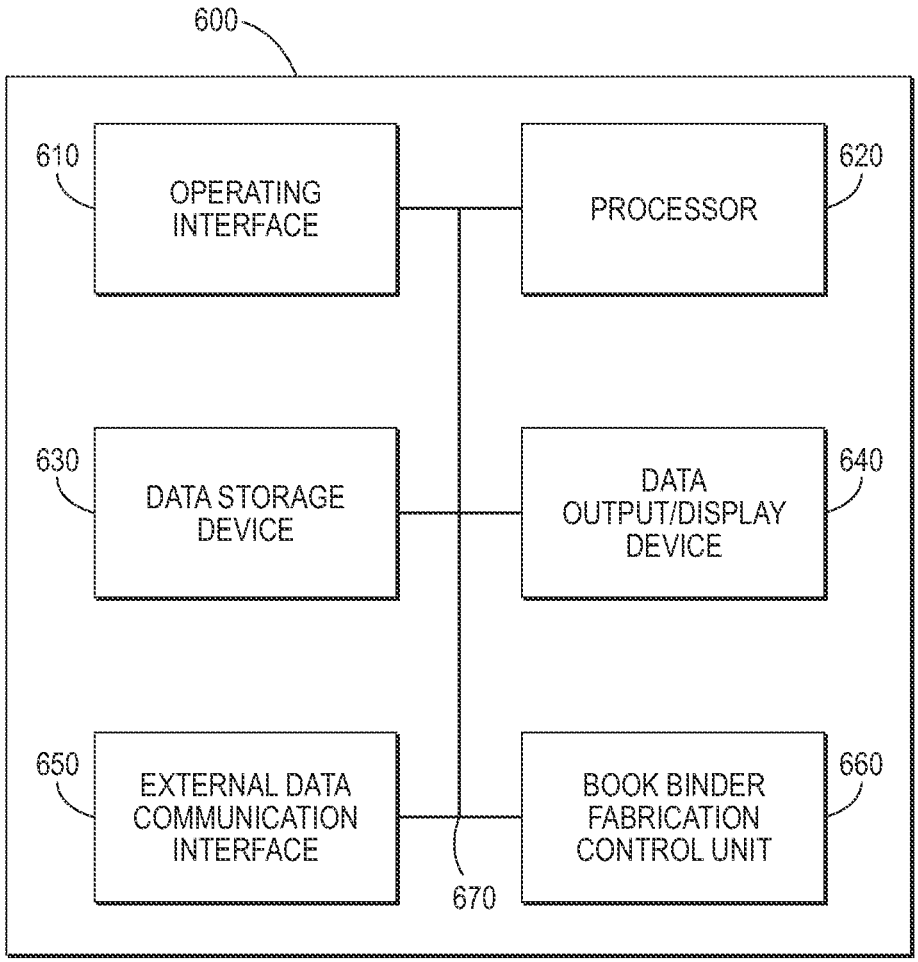
FIG. 6 illustrates a block diagram of a control system for controlling characteristics of a book binding process in an image forming device according to this disclosure.

FIG. 6 illustrates a block diagram of a control system 600 for controlling characteristics of a book binding process in an image forming device according to this disclosure.

The exemplary control system 600 may include an operating interface 610 by which a user may communicate with the exemplary control system 600 for directing portions of the book binding operations, including temperature and pressure control in a heatable bending unit and cooperating heated through rod such as those described above, via one or more book binder fabrication control units 660. The operating interface 610 may be a locally accessible user interface associated with an image forming system, which may be configured as one or more conventional mechanisms common to control devices and/or computing devices that may permit a user to input information to the exemplary control system 600. The operating interface 610 may include, for example, a conventional keyboard, a touchscreen with "soft" buttons or with various components for use with a compatible stylus, a microphone by which a user may provide oral commands to the exemplary control system 600 to be "translated" by a voice recognition program, or other like device by which a user may communicate specific operating instructions to the exemplary control system 600. The operating interface 610 may be a part of a function of a graphical user interface (GUI) mounted on, integral to, or associated with, the image forming system with which the exemplary control system 600 is associated to direct post-processing book binding operations in the associated image forming system.

The exemplary control system 600 may include one or more local processors 620 for individually operating the exemplary control system 600 and for carrying out operating functions of calculating a bend radius and implementing a bending process for individual binding elements in the manner described above. Processor(s) 620 may include at least one conventional processor or microprocessor that interprets and executes instructions to direct specific functioning of the exemplary control system 600 and an associated image forming system for post-processing of the documents.

The exemplary control system 600 may include one or more data storage devices 630. Such data storage device(s) 630 may be used to store data or operating programs to be used by the exemplary control system 600, and specifically the processor(s) 620. Data storage device(s) 630 may be used to store information regarding, for example, glass transition temperatures and melting temperatures for a range of selectable materials that may be employed to form the individual binding elements for the disclosed book binding process. Other material parameters may also be stored for the select materials. Standard thickness measurements for a selection of image receiving medium substrates and cover elements may be stored as well to facilitate a calculation of a total thickness of a stacked document to be bound according to the disclosed schemes. Stored schemes and operating parameters may be references to control aspects of the book binding process for sizing, heating, bending and gluing the individual binding elements.

The data storage device(s) 630 may include a random access memory (RAM) or another type of dynamic storage device that is capable of storing updatable database information, and for separately storing instructions for execution of system operations by, for example, processor(s) 620. Data storage device(s) 630 may also include a read-only memory (ROM), which may include a conventional ROM device or another type of static storage device that stores static information and instructions for processor(s) 620. Further, the data storage device(s) 630 may be integral to the exemplary control system 600, or may be provided external to, and in wired or wireless communication with, the exemplary control system 600.

The exemplary control system 600 may include at least one data output/display device 640, which may be configured as one or more conventional mechanisms that output information to a user, including, but not limited to, a display screen on a GUI of the image forming system with which the exemplary control system 600 may be associated. The data output/display device 640 may be used to indicate to a user a status of a post-processing, book binding operation in an image forming system.

Where appropriate, the exemplary control system 600 may include at least one external data communication interface 650 by which the exemplary control system 600 may communicate with the post-processing system in the image forming system for effecting book binding employing a series of bendable binding elements when the exemplary control system 600 is mounted remotely from and in wired or wireless communication with the associated image forming system.

All of the various components of the exemplary control system 600, as depicted in FIG. 6, may be connected internally, and potentially to a post-processing device in an image forming system, by one or more data/control busses 670. These data/control busses 670 may provide wired or wireless communication between the various components of the exemplary control system 600, whether all of those components are housed integrally in, or are otherwise external and connected to, other components of an image forming system with which the exemplary control system 600 may be associated.

It should be appreciated that, although depicted in FIG. 6 as an essentially integral unit, the various disclosed elements of the exemplary control system 600 may be arranged in any combination of sub-systems as individual components or combinations of components, integral to a single unit, or external to, and in wired or wireless communication with, the single unit of the exemplary control system 600. In other words, no specific configuration as an integral unit or as a support unit is to be implied by the depiction in FIG. 6. Further, although depicted as individual units for ease of understanding of the details provided in this disclosure regarding the exemplary control system 600, it should be understood that the described functions of any of the individually-depicted components may be undertaken, for example, by one or more processors 620 connected to, and in communication with, one or more data storage device(s) 630, all of which may support operations in the associated image forming system.

Figure 7:
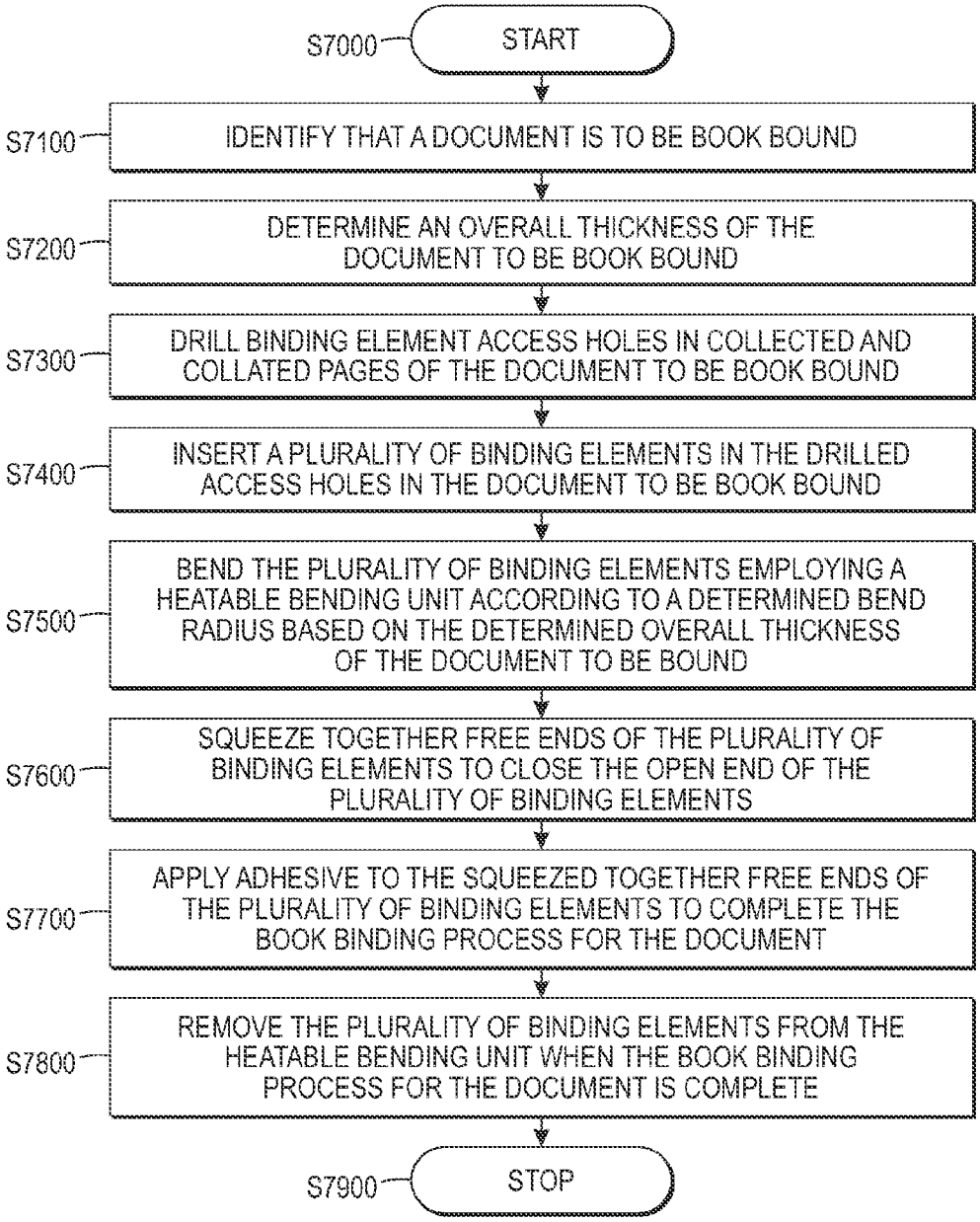
FIG. 7 illustrates a flowchart of an exemplary method for implementing a book binding process in an image forming device according to this disclosure.

The disclosed embodiments may include methods for controlling characteristics of a book binding process in an image forming device. FIG. 7 illustrates a flowchart of such an exemplary method. As shown in FIG. 7, operation of the method commences at Step S7000 and proceeds to Step S7100.

In Step S7100, an indication may be received indicating that a particular document, which includes at least a specified number of image formed pages, is to be book bound. Operation of the method proceeds to Step S7200.

In Step S7200, an overall thickness of the document to be bound may be determined. The overall thickness may be calculated based on an average thickness of individual sheets multiplied by the number of involved sheets, supplemented by a thickness of any cover elements to be added to the stack of image-formed sheets. Operation of the method proceeds to Step S7300.

In Step S7300, a collected and collated set of image-formed pages may be drilled to provide binding element access holes, preferably rectangular, through the collected and collated set of image-formed pages. Operation of the method proceeds to Step S7400.

In Step S7400, a plurality of binding elements, which may be individually cut from a strip of binding element material, may be inserted into the drilled binding element access holes. Operation of the method proceeds to Step S7500.

In Step S7500, the plurality of binding elements may be bent, individually, collectively, or in specified groups, by employing a heatable bending unit, and potentially a cooperating heated through rod, to introduce heat and reduce stress in the bending portion of the plurality of binding elements. The plurality of binding elements may be bent according to a bend radius that may be controlled based on interaction of the heatable bending unit and the heated through rod with the binding elements, the bend radius having been determined according to a determined thickness of the collection of pages in the document to be bound. The determined bend radius may be limited according to a lower threshold. Operation of the method proceeds to Step S7600.

In Step S7600, the free ends of the plurality of now bent binding elements may be squeezed together to close the open ends of the loops formed by the plurality of binding elements. Operation of the method proceeds to Step S7700.

In Step S7700, an adhesive is applied to the squeezed together free ends of the plurality of binding elements to secure the free ends to one another to, thereby, complete the loop formation process for the plurality of binding elements. Operation of the method proceeds to Step S7800.

In Step S7800, the plurality of binding elements may be removed from the heatable bending unit when the book binding process is complete, the residual stresses in the plurality of binding elements having been relieved as much as possible through the heating and sizing process. Operation of the method proceeds to Step S7900, where operation of the method ceases.

The above-described exemplary systems and methods reference certain conventional components to provide a brief, general description of suitable document post-processing means by which to carry out the disclosed book binding processes. Those skilled in the art will appreciate that other embodiments of the disclosed subject matter may be practiced with many types and configurations of devices common to book bound document production.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 7, and the accompanying description, except where a particular method step is a necessary precondition to execution of any other method step. Individual method steps may be carried out in sequence or in parallel in simultaneous or near simultaneous timing.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A method for binding a stack of media substrates, comprising:

inserting a plurality of binding element strips, one each in a plurality of binding holes in media substrates for binding a stack of the media substrates;

applying heat to bending portions of the plurality of binding element strips to facilitate bending of the binding element strips at the bending portions;

bending the bending portions of the plurality on binding element strips while applying the heat to the bending portions;

squeezing free ends of the bent binding element strips together; and securing the free ends of the bent binding element strips to each other to form the bent binding element strips into finished binding loops to bind the stack of media substrates, wherein the heat is applied to the bending portions using a heatable appliance that applies the heat to the binding element strips in a manner that controls a bend radius formed of the bending portions, the heatable appliance including a heated rod component that is brought into contact with an inner surface of the bending portions, and a heated bending unit having a variable width between opposing heated surfaces, the opposing heated surfaces being brought into contact with an outer surface of the bending portions.

2. The method of claim 1, the plurality of binding element strips being cut from a supply of the binding element strip material.

3. The method of claim 2, the binding element strip material having a thickness in a range of 0.15 mm to 0.40 mm.

4. The method of claim 1, at least one of the heated rod component and the heatable bending unit being heated to a temperature that is different from a temperature of the other of the heated rod component and the heatable bending unit.

5. The method of claim 1, the heated rod component being brought into contact with the inner surface of the bending portions before the heated bending unit is brought into contact with the outer surface of the bending portions.

6. The method of claim 1, further comprising:

determining with a processor an overall thickness of the stack of media substrates; and calculating with the processor a specified bend radius for the bending portions based on the determined overall thickness of the stack of media substrates.

7. The method of claim 6, the determining the overall thickness of the stack of media substrates comprising physically measuring the overall thickness of the stack of media substrates.

8. The method of claim 6, the specified bend radius being calculated to maximize the bend radius of the bending portions of the binding element strips while minimizing an increase in the overall thickness of the stack of media substrates at a binding portion based on a presence of the finished binding loops binding the stack of media substrates.

9. The method of claim 6, further comprising:

determining with the processor a minimum bend radius for the bending portions of the binding elements; and setting with the processor the specified bend radius for the bending portions to be substantially equal to the determined minimum bend radius when the calculating of the specified bend radius for the bending portions based on the determined overall thickness of the stack of media substrates returns a value that is less than the determined minimum bend radius.

10. The method of claim 9, the minimum bend radius being determined according to a relationship between a plurality of characteristic variables for a binding element strip material as follows:

$$T=2*(\sigma/E)*\rho$$

where: T is a thickness of the binding element strip material from which the binding elements are formed measured in a direction in which the bend radius is formed; ρ is a radius of curvature of the bend radius; E is an elastic modulus of the binding element strip material; and σ is a bending yield strength of the binding element strip material.

11. The method of claim 10, further comprising:

storing material characteristics for a plurality of binding element strip materials in a storage device; and referencing with the processor the material characteristics for the binding element strip material from which the binding element strips are formed to obtain values for the plurality of characteristic variables for determining the minimum bend radius according to the relationship.

12. The method of claim 11, the stored material characteristics including glass transition temperatures and melting temperatures for the plurality of binding element strip materials, and the heat applied to the binding element strips being maintained in a temperature range between the glass transition temperature and the melting temperature for the binding element strip material from which the binding element strips are formed.

13. The method of claim 6, further comprising:

moving the heated rod component in contact with an inner surface of the bending portions of the binding element strips toward an opening between the opposing heated surfaces of the heated bending unit in contact with an outer surface of the bending portions; and bending the bending portions according to relative movement of the heated rod component and the heated bending unit until the bend radius of the bending portions substantially equals the calculated specified bend radius for the bending portions.

14. The method of claim 13, further comprising removing the binding element strips from contact with heated surfaces of the heatable appliance when the bend radius is formed in the bend portions.

15. A system for binding a stack of media substrates comprising:

a binding material supply unit that supplies a plurality of binding element strips for inserting one each in a plurality of binding holes in media substrates for binding a stack of the media substrates;

a heatable appliance that applies heat to bending portions of the plurality of binding element strips to facilitate bending of the binding element strips at the bending portions;

presser elements that squeeze free ends of the bent binding element strips together; and an adhesive unit that secures the free ends of the bent binding element strips to each other to form the bent binding element strips into finished binding loops, wherein the heatable appliance includes a heated rod component that is brought into contact with an inner surface of the bending portions, and a heated bending unit having a variable width between opposing heated surfaces, the opposing heated surfaces being brought into contact with an outer surface of the bending portions.

16. The system of claim 15, at least one of the heated rod component and the heatable bending unit being heated to a temperature that is different from a temperature of the other of the heated rod component and the heatable bending unit.

17. The system of claim 15, the heated rod component being brought into contact with the inner surface of the bending portions before the heated bending unit is brought into contact with the outer surface of the bending portions.

18. The system of claim 15, further comprising a processor that is programmed to:

determine an overall thickness of the stack of media substrates, and calculate a specified bend radius for the bending portions based on the determined overall thickness of the stack of media substrates.

19. The system of claim 18, the processor being programmed to determine the overall thickness of the stack of media substrates by receiving a physical measurement of the overall thickness of the stack of media substrates.

20. The system of claim 18, the processor calculating the specified bend radius to maximize the bend radius of the bending portions of the binding element strips while minimizing an increase in the overall thickness of the stack of media substrates at a binding portion based on a presence of the finished binding loops binding the stack of media substrates.

21. The system of claim 18, the processor being further programmed to:

determine a minimum bend radius for the bending portions of the binding elements, and set the specified bend radius for the bending portions to be substantially equal to the determined minimum bend radius when the processor calculates the specified bend radius for the bending portions based on the determined overall thickness of the stack of media substrates to be a value that is less than the determined minimum bend radius.

22. The system of claim 21, the processor being further programmed to determine the minimum bend radius according to a relationship between a plurality of characteristic variables for a binding element strip material as follows:

$$T=2*(\sigma/E)*\rho$$

where: T is a thickness of the binding element strip material from which the binding elements are formed measured in a direction in which the bend radius is formed; ρ is a radius of curvature of the bend radius; E is an elastic modulus of the binding element strip material; and σ is a bending yield strength of the binding element strip material.

23. The system of claim 22, further comprising a storage device that stores material characteristics for a plurality of binding element strip materials in a storage device, the processor being further programmed to reference the material characteristics for the binding element strip material from which the binding element strips are formed to obtain values for the plurality of characteristic variables for determining the minimum bend radius according to the relationship.

24. The system of claim 23, the stored material characteristics including glass transition temperatures and melting temperatures for the plurality of binding element strip materials, the processor being further programmed to control the heat applied to the binding element strips in a temperature range between the glass transition temperature and the melting temperature for the binding element strip material from which the binding element strips are formed.

25. The system of claim 18, the processor being further programmed to:

control a movement of the heated rod component in contact with an inner surface of the bending portions of the binding element strips toward an opening between the opposing heated surfaces of the heated bending unit in contact with an outer surface of the bending portions, and bend the bending portions according to relative movement of the heated rod component and the heated bending unit until the bend radius of the bending portions is determined to be substantially equal to the calculated specified bend radius for the bending portions.

26. A non-transitory computer readable medium on which is stored a set of instructions that, when executed by a processor, cause the processor to execute the steps of a method for binding a stack of media substrates, the method comprising:

inserting a plurality of binding element strips, one each in a plurality of binding holes;

applying heat to bending portions of the plurality of binding element strips to facilitate bending of the binding element strips into loops at the bending portions;

bending the bending portion of the plurality on binding element strips while applying the heat to the bending portions;

squeezing free ends of the bent binding element strips together; and securing the free ends of the bent binding element strips to each other to form the bent binding element strips into finished binding loops to bind the stack of media substrates, wherein the heat is applied to the bending portions using a heatable appliance that applies the heat to the binding element strips in a manner that controls a bend radius formed of the bending portions, the heatable appliance including a heated rod component that is brought into contact with an inner surface of the bending portions, and a heated bending unit having a variable width between opposing heated surfaces, the opposing heated surfaces being brought into contact with an outer surface of the bending portions.

* * * * *